United States Patent [19]

Appleton, Richard E.

[11] Patent Number: 4,799,669

[45] Date of Patent: Jan. 24, 1989

[54] SWING

[76] Inventor: Appleton, Richard E., 303 S. 9th St., Midlothian, Tex. 76065

[21] Appl. No.: 100,906

[22] Filed: Sep. 25, 1987

Related U.S. Application Data

[63] Continuation-in-part of Ser. No. 019,257, Feb. 26, 1987, abandoned.

[51] Int. Cl.[4] ..... A63G 9/16

[52] U.S. Cl. ..... 272/85; 272/97; 297/277; 297/278; 297/279

[58] Field of Search ..... 272/85, 86–92; 297/273, 276, 277, 278, 279, 280, 281, 282, 255, 440

[56] References Cited

U.S. PATENT DOCUMENTS

| | | | |
|---|---|---|---|
| 424,329 | 3/1890 | Messmore | 297/278 |
| 465,017 | 12/1891 | Eller | 297/277 |
| 953,591 | 3/1910 | Bringham | 297/279 |
| 1,061,462 | 5/1913 | Foster | 297/277 X |
| 1,189,393 | 7/1916 | Shaw | 297/276 |
| 1,192,941 | 8/1916 | Schmid | 297/277 |
| 1,240,089 | 9/1917 | Pottinger | 297/279 |
| 1,538,601 | 5/1925 | Talbert | 297/277 |
| 1,689,397 | 10/1928 | Lee | 297/281 |
| 2,520,377 | 8/1950 | Schrougham | 297/278 |
| 4,221,429 | 9/1988 | Wade | 297/277 |
| 4,456,244 | 6/1984 | Andrews | 272/92 |

*Primary Examiner*—David A. Scherbel
*Assistant Examiner*—Richard E. Chilcot, Jr.
*Attorney, Agent, or Firm*—Fails, James C.; Arthur F. Zobal

[57] ABSTRACT

A balanced, tiltable swing swingingly suspended from an upper support and above a lower support characterized by a main body portion having longitudinal extending lath members for defining a seat canopy, window openings and the like, a foot support connected with the main body portion and extending downwardly such that the foot support will contact the lower support when the swing is tilted forward; a main tilt beam traversing longitudinally and supported at each end by respective chains; respective auxiliary chains connected with the back of the seat portion and the main support chains and with the respective springs connected intermediate the chains to control the force required to tilt the seat, and the degree of tilt of a given swing and load. If desired, the canopy can be omitted. Also, a base support can be employed to facilitate installation almost anywhere.

10 Claims, 2 Drawing Sheets

SWING

CROSS REFERENCE TO RELATED APPLICATIONS

This application is a continuation-in-part of application Ser. No. 019,257, filed Feb. 26, 1987, same inventor and same title.

FIELD OF THE INVENTION

This invention relates to swings; and, more particularly, to suspended swings, such as porch or patio swings, for supporting one or more occupants from a main support beam such that the occupants can swing themselves in the swing in which they sit.

DESCRIPTION OF THE PRIOR ART

The prior art has seen the development of a wide variety of approaches to body support means that can be swung. These have ranged from hammocks through rope swings supported outdoors, to porch swings for being supported on porches, or verandas. Illustrative of the type of prior art found with a search are the following U.S. patents:

U.S. Pat. No. 424,329, Messmore, discloses a convertible hammock and chair suspended from a hook by ropes through a loop 11 such that the occupant could lean backwardly or support himself in a more nearly sitting position.

U.S. Pat. No. 465,017, Eller, discloses a swinging chair in which the back of the chair is supported by way of a swing so as to enable a bouncing or reclining motion to be experienced by the occupant, such as a child in the swing.

U.S. Pat. No. 953,591, Bringham, discloses an adjustable swinging chair in which a back is suspended from an arm 16 that is connected, as by eye 20, with a suspending rope or the like.

U.S. Pat. No. 1,061,462, Foster, discloses a swing seat in which the seat is suspended from a pair of ropes 6 and has a detachable swing seat with lower foot rests for a child or the like.

U.S. Pat. No. 1,189,393, Shaw, discloses a swing supported by front and back ropes over respective pulleys and having a stop at the top such that the movement of the rope over the pulley can be stopped when a desired degree of tilt has been achieved. Individual chairs are disclosed.

U.S. Pat. No. 1,192,941, Schmid, discloses a swing with a shaped body support formed by structural members and laths running longitudinally of the swing. The front and back supports are connected with chain which is connected with a main link supported from a single chain which is supported from a single eye hook at each end of the swing.

U.S. Pat. No. 1,240,089 discloses a swing suspended from a platform or the like and having an adjustable center support 5 where the height of the swing seat can be adjusted. By way of a pivotable connection, the back can swivel about its pivot connection and the footrest can be swiveled forwardly about its pivot connection. The seat and the back are also pivotally connected together, as is the seat and the leg support portion.

U.S. Pat. No. 1,538,601, Talbert, discloses a porch swing having bifurcated chains supported within a loop of a main support chain and with springs on the back chains to provide a means for varying the character of the swing or any vibratory movement.

U.S. Pat. No. 1,689,397, Lee, discloses a porch swing attachment having springs at the front and rear of arm rest members to accomodate vibratory motion in addition to swinging from a cable 6 or the like.

U.S. Pat. No. 2,520,377, Schrougham, discloses a swing seat in which respective supports 39, 41 at each end terminate in a bifurcated element 36 connected with a suspended swing seat. Overhead support railings are defined in the outdoor swing of this invention.

U.S. Pat. No. 4,221,429, Wade, discloses a suspended recliner having leg supports that can be tilted into position or out of position and forming a reclining hammock-like structure suspended from a single ring 48.

From the foregoing, it can be seen that the prior art has failed to provide a balanced, tiltable porch swing having a main body providing seats for one or more occupants and providing a balance wherein the swing can be tilted forwardly so that a foot rest would encounter a main support, such as a floor, to facilitate ingress and egress from the swing and in which the swing can be tilted backwardly to lift the foot support from the floor and gently swung at the frequency desired by the occupant by simple movement of the head, yet can be readily swung forwardly again if desired.

SUMMARY OF THE INVENTION

Accordingly, it is an object of this invention to provide a balanced, tiltable swing that is suspended and can be tilted forwardly to facilitate ingress and egress; yet, can be tilted either forwardly or backwardly at the convenience and desire of the occupants and easily swung at the desired frequency.

It is a specific object of this invention to provide a swing having a main body portion defining a seat and canopy that can be tilted forwardly to contact a foot support with a floor or the like and be tilted forwardly or backwardly as desired by the occupants; yet, can be swung easily by a simple movement of the head once it is suspended with the foot rest raised out of contact with the floor.

It is a specific object of this invention, also, to provide a base support for supporting the swing, while achieving the other objects of the invention delineated hereinbefore.

These and other objects will become apparent from the descriptive matter hereinafter, particularly when taken in conjunction with the appended drawings.

DESCRIPTION OF PREFERRED EMBODIMENT(S)

Figure 1:
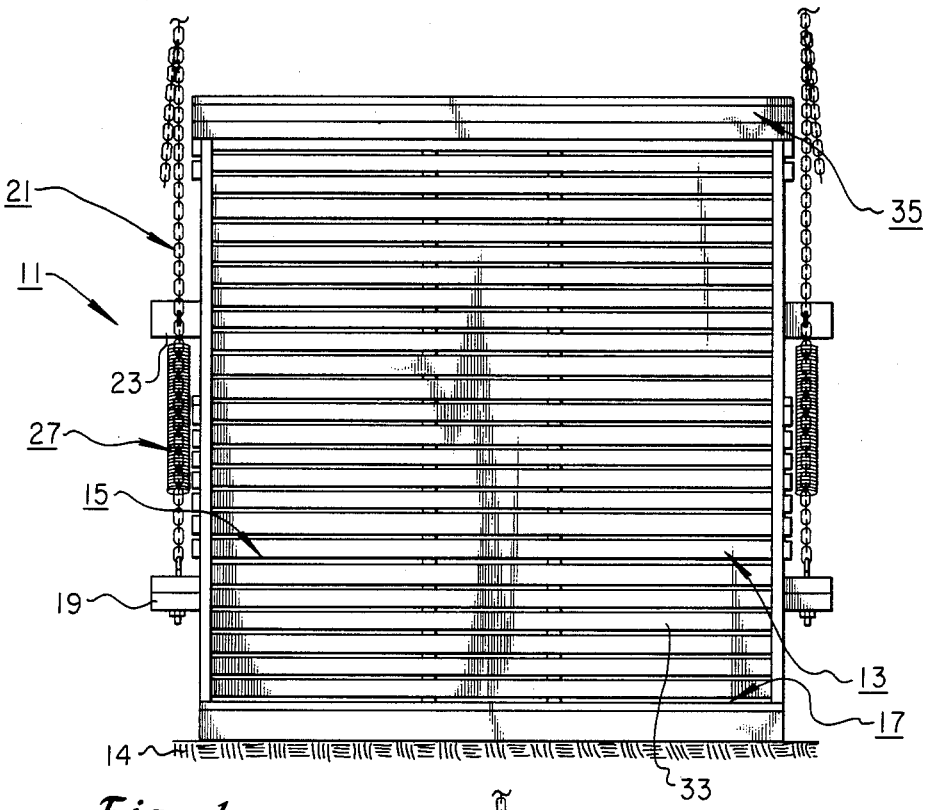
FIG. 1 is a front elevational view of the swing in accordance with one embodiment of this invention.
Figure 2:
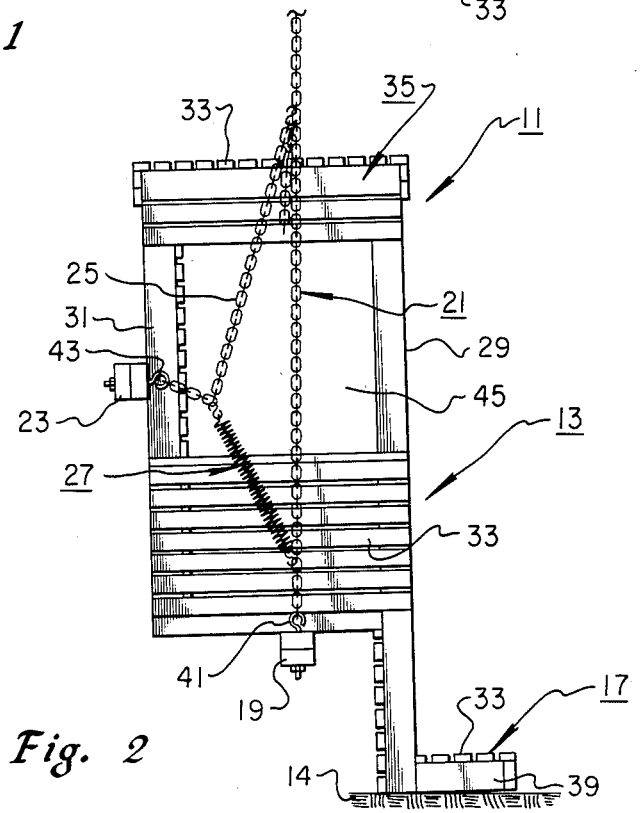
FIG. 2 is a side elevational view of the swing of FIG. 1.

Referring to FIGS. 1 and 2, the swing 11 is illustrated. The swing 11 is a balanced, tiltable swing that is swingingly suspended from an upper support, such as beam of a ceiling or a beam on a base portion. Specifically, the swing is balanced for tilting about a beam 19.

The swing 11 comprises a main body portion 13 having a seat 15 for supporting at least one person occupant, and preferably two or more. The swing 11 also comprises a foot support 17 that extends downwardly such that the foot support can come in contact with a lower support, such as a floor 14, when the swing is tilted forwardly. The swing 11 also comprises a main tilt beam 19 traversing longitudinally of the main body portion 13. Thus it can be seen that the main beam 19 serves as a pivotal beam supporting the swing 11 and disposed near the center of gravity of the swing 11 with the swing 11 substantially balanced thereover and such that the swing can be tilted forwardly or backwardly with respect to the beam with very little unbalancing force. Specifically, the weight of the swing forward of the beam 19 is substantially equal to the weight rearwardly of the unbalancing beam, although it may be slightly greater such that the foot support can come to rest on the lower support 14. By "very little force" is meant that as little as ten pounds placed at the rear of the seat of the swing can unbalance the swing to cause it to tilt rearwardly or about the beam 19 and raise the foot support 17 from the lower support 14. In this way, when a person sits in the swing with the extra weight of the person rearwardly of the beam, the swing will be tilted rearwardly to lift the foot support 17 from the lower support 14. Thereafter, the swing can be swung forwardly or rearwardly merely by nodding the head of the occupant.

The swing 11 also includes a plurality of main lineal supporting members 21, with at least one member being disposed at each end of the main tilt beam 19. The main lineal support members 21 are connected with the upper support and the main tilt beam 19. The swing 11 also comprises a back support beam 23 that is connected with the main body portion and disposed a predetermined distance; for example, about sitting shoulder height, or about 20 inches; above the seat 15. The back support beam 23 will be a suitably strong beam that is connected with the main body portion 13 and forms another support beam for connecting with auxiliary lineal supporting members, directly or by way of an intermediate portion of the main lineal support member 21. The swing 11 also includes a plurality of auxiliary lineal support members 25, disposed at least one at each end, connected to support the back of the swing. As illustrated, the auxiliary support members 25 are connected with, respectfully, the main lineal support members 21 and with the back support beam 23. The swing 11 also includes a biasing means 27 connected intermediate the main lineal support members 21 and the auxiliary lineal support members 25 for controlling the force required to tilt the swing 11 forwardly or backwardly and the degree of tilt.

The main body portion 13 includes a structural framework of substantially vertical members 29, 31 at the front and back having a plurality of lath members 33 traversing intermediate and being affixedly connected to the vertical support members 29, 31, as by nailing. The term "vertical" support members is meant substantially vertical when operationally hung in the correct position, as illustrated in FIGS. 1 and 2. The structural framework may have any desired cross bracing or the like as needed. In the illustrated embodiment, the structural framework may comprise two inch (") thick by four inch wide vertical members 29, 31 made of wood and the lath members 33 may comprise wooden laths that are nailed to the support members and in which the whole swing sits astride the main tilt beam 19. If desired, of course, the main body portion may have the structural framework so as to define an arcuate seat 15 instead of a flat seat 15, as illustrated. The seat 15 comprises the respective horizontally disposed lath members 33 traversing substantially longitudinally and being disposed laterally adjacent one another. If desired a small space may be between the lath members 33. As illustrated, the seat 15 is formed of wood and is formed of the structural framework and the lath members depicted and delineated herein. If desired, however, other materials such as aluminum could be fabricated to form the respective elements delineated.

As illustrated in FIGS. 1 and 2, the main body portion 13 includes a canopy 35. The canopy 35 may be formed of suitable laterally disposed structural members and longitudinally traversing lath members 33. As implied with respect to the structure hereinbefore, any suitable material may be employed for making the canopy. In addition to the wooden or metal lath and structural members delineated hereinbefore for supporting the weight, plastic members could be employed for the canopy, if desired. Ordinarily, it is advantageous to employ the same materials of construction, so wooden structural and lath members are preferred if they are what is employed in the remainder of the swing 11. It is important to note that the forward vertical member 29 extends downwardly to suppport the foot support 17.

The foot support 17, similarly may comprise structural members that protrude such as beam 39 and longitudinally extending laths 33. For example, the main support member 39 may comprise two inch thick by four inch wide hard wood as described. Since the foot support will rest on the bottom support, such as a floor, it does not require a great deal of structural strength.

The main support beam 19, on the other hand, will bear most of the weight of the occupants and the swing, so should be structurally substantial and strong. Expressed otherwise, it should measure four inches by four inches such as two beams, each two inch thick by four inches wide affixed together or a central four inch by four inch beam. As illustrated, the main tilt beam 19 contains in each end, eye bolts 41 for affixing a chain or a main lineal supporting member thereto. As is recognized, an eye bolt is simply with an eye at the top and having a nut, with or without suitable washers or the like, on the other end after being inserted the beam through a suitable aperture, such as a drilled aperture extending through the beam 19.

The main lineal supporting members 21 may comprise chain, cable, rope or the like as desired. As illustrated, they comprise a main chain that has one of its links connected with the eye bolt 41. Of course, the means of interconnection with the eye bolt will be appropriate to the type of main lineal supporting member employed. In the illustrated embodiment where the main lineal member is a chain, the link may be simply interconnected with the eye. On the other hand, a cable may be doubled back and fastened to itself, a rope may be tied or doubled back and fastened to itself.

The top end of the main lineal member 21 is connected with the top support such as a ceiling beam, a main beam on a support base portion or the like. The connection may be appropriate, for example, as by eye bolts or by being looped over the beam and fastened.

The auxiliary lineal supporting members may comprise any suitable member such as chain, cable, rope or the like. As illustrated, each auxiliary lineal support member comprises a second chain 25 that has its link connected with the eye bolt 43 in the back beam 23, similarly as illustrated and described with respect to the main eye bolt 41. Similarly, if cable or rope are connected as the auxiliary supporting members, they are suitably fastened as discussed hereinbefore. In the illustrated embodiment, the other end of the auxiliary chain, or lineal supporting member is connected with the main supporting lineal member above the canopy 35, FIG. 2.

In the illustrated embodiments, the main lineal support members are connected with the supporting beams overhead and the auxiliary lineal support members are connected with the main lineal support members about 60 links above the bottom to form a bifurcation. As illustrated, the back support beam is fixed in its relationship with the others and does not move relative to the other parts of the swing. It is fixed in this particular position because of the degree of tilt and to assure proper clearance of the foot rest above the floor when the swing is in operation. Moreover, this assures proper distance to adjust the spring to proper tension on the chain so the swing will react upon a given weight for tilting of the swing. Chain links and springs are an important factor in determining the force it takes to make the swing react to operational weight. Also, the way the swing sets when unoccupied without the spring so as to have the foot rest on the floor, is important in interconnection of the respective spring and lineal support members. The spring is interconnected at a permanent pint along the lineal support members to give the desired interaction as noted hereinbefore.

The foot rest is important not only in facilitating egress and ingress but also to prevent the legs from falling asleep and assure good blood circulation as the occupant swings. Also the foot rest serves as a stop or break to keep the swing from falling to far forwardly and to keep it from reacting when an occupant steps into the swing.

The biasing means 27 may comprise any of the biasing means that are suitable for this application. As illustrated, it comprises a lineal spring. The lineal spring is connected six links above the connection with respective eye bolts, as measured along the respective chains extending from the eye bolts, toward a point of connection between the two chains serving as the supporting means. In the illustrated embodiment, the spring is a ten inch spring having a wire size 0.072 inch and an outside diameter of 0.812 inch and available from Raymond Merchandise Division of the Barnes Group, Inc., Corry, Pa., 16407. As will be apparent, the force of the biasing means may be varied, as well as varying the points of connection with the respective lineal supporting members, to control the force required to tilt the swing rearwardly by the occupant and to lift the foot support 17 off the floor on which it rests and upon egress of the occupant; and to control the degree of tilt of the swing with a given load.

An opening 45 is employed at each end of the swing illustrated in FIGS. 1 and 2, so the occupant can see externally of the swing through the ends when a canopy is employed. The opening is formed in the shape of a square or rectangularly shaped window simply by the omission of the lath members 33 in the illustrated embodiments.

In operation, the swing will be tilted forwardly as illustrated in FIG. 2 and a person occupant can simply step on the foot support 17 and sit on the seat 15. The act of seating; and, particularly, when the occupant leans backward; creates an unbalanced force sufficient to lift the foot rest 17 from the lower support 14. This causes the foot rest 17 to lift free of the floor and the occupants can then swing simply by moving their heads forwardly and rearwardly at the desired frequency.

At such time as the occupants desire to leave the swing, they simply lean forwardly. This causes the foot support 17 to come again in contact with the floor and stop the swing, facilitating egress by the occupants.

Figure 3:
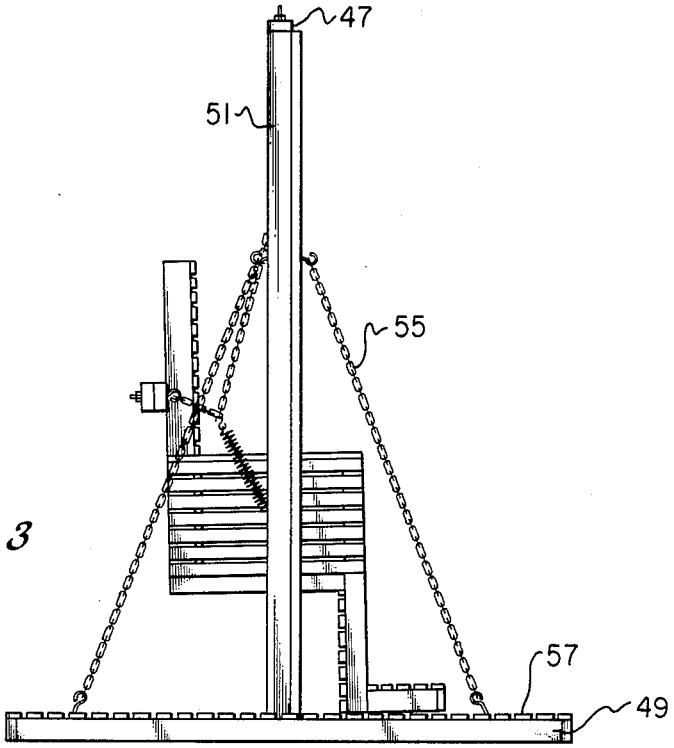
FIG. 3 is an end view of the swing of FIG. 1 suspended on a support.
Figure 4:
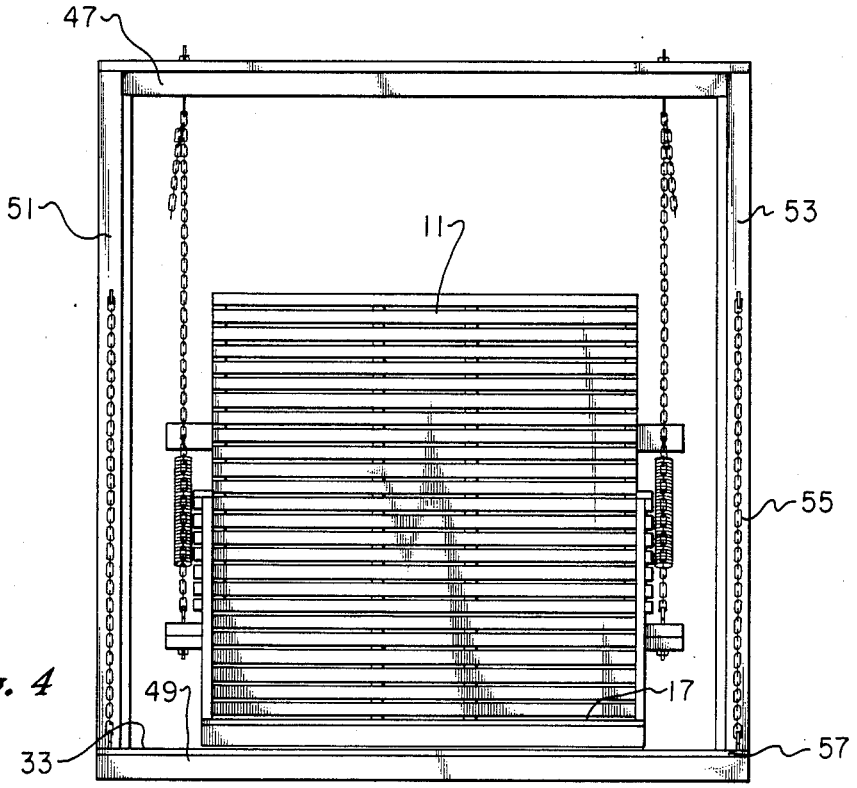
FIG. 4 is a front view of the swing and support of FIG. 3.

Referring to FIGS. 3 and 4, if desired, the swing can be made without a canopy. In this instance, the swing looks like the swing illustrated in FIG. 4 in which the swing 11 does not have a canopy over it. Otherwise, the swing 11 in FIG. 4 is substantially the same as described hereinbefore with respect to FIGS. 1 and 2. It has the foot rest and the longitudinally extending laths over the supporting members.

The swing is supported from a main beam 47 of a support base 49. As illustrated, the support base comprises structural members such as four inch wide by four inch thick members and has erect vertical beams 51, 53 supporting the main beam 47. To maintain the vertical beam substantially vertical, lineal brace members 55 are connected with the vertical members 51 and 53 and with the floor structure 57. As illustrated, the lineal members forming the braces are chains and are connected by way of eye bolts, similarly as described hereinbefore with respect to the swings. Other suitable means can be employed as desired. In fact, if desired, the braces could themselves be rigid members; such as, boards, metal braces, or the like. As illustrated, laths 33 are also emplaced longitudinally on the floor structure in order to provide ease of walking by the person or occupant in getting to the swing.

In operation, the swing operates substantially as described hereinbefore. Specifically, the foot rest is in normal "at rest" condition in contact with and resting on the laths 33 forming part of the floor 57 of the support base 49. The occupant thus steps onto the foot support and thence into the swing. As the occupant seats and leans back in the swing, the swing is tilted rearwardly similarly as described hereinbefore. Once the swing tilts rearwardly to lift the foot rest 17 off of the floor 57, the swinging can be begun, as by nodding the head forwardly or rearwardly. The first swing imparted will be a longlasting swing and the occupant can swing gently until the movement of the swing is as low as the occupant desires. Thereafter, the occupant can simply lean his head toward the front of the swing to cause the swing to swing similarly, the forward and backward movement of the head is all that is necessary to cause the swing to swing.

For egress, the swing can be tilted forwardly to emplace the foot support 17 on the floor 57; or, more specifically, on the laths 33 on the floor structure 57. This should be done only after the magnitude of the swing is sufficiently low that no undue force is encountered in the stopping of the swing. Thereafter, the occupant can simply step from the swing.

It is noteworthy that in the claims, the respective links of the chain are described as measures of distance because that is what the inventor has employed in this invention. The use of the terminology first and second links in the claims does not connote distances as does the use of links otherwise. Instead, they are simply to prevent lack of clarity in the claims.

What is claimed is:

1. A balanced, tiltable swing swingingly suspended from an upper support and above a lower support comprising:

a. a main body portion having a seat for supporting at least one person occupant;

b. a foot support portion connected with said main body portion and extending downwardly such that said foot support portion will contact the lower support when the swing is tilted forward;

c. a main tilt beam traversing longitudinally of said main body support and disposed near the center of gravity of said main body support with said main body support substantially balanced thereover when unoccupied and operationally hung and such that said main body support can be tilted one of forward and backward with very little unbalancing force;

d. a plurality of main lineal support members, with at least one member being disposed at each end of said main tilt beam; said respective main lineal support members being respectively connected with the upper support and with said main tilt beam;

e. a back support means connected with said main body portion and disposed a predetermined distance above said seat;

f. a plurality of auxiliary lineal supporting members, disposed at least one at each end, connected with respective said lineal support members and with said back support beam; and g. a biasing means connected intermediate respective said main lineal support member and said auxiliary lineal support member at each end for controlling the force required to tilt said swing backwardly by an occupant person and the degree of tilt;

such that an occupant person can step onto said foot portion and be seated in said main body portion, tilt said main body portion backwardly easily and swing by a simple oscillating movement of the head at the proper frequency.

2. The swing of claim 1 wherein said main lineal support members comprise respective chains at each end of said swing, the upper support comprises an overhead beam and the lower support comprises a floor.

3. The swing of claim 2 wherein said main lineal support members and said auxiliary support members each comprise respective chains; each end of said back support beam and said main tilt beam have respective eye bolts for being connected with respective first links in said main lineal support chain and auxiliary lineal support chain; wherein said biasing means is a spring and said spring is connected with said main lineal support chain and said auxiliary support chain six links above said first link.

4. The swing of claim 1 wherein said body and seat include a structural framework having longitudinally extending lath members.

5. The swing of claim 4 wherein said structural framework includes substantially vertical members when operationally hung and wherein openings are employed at each end of the swing at substantially occupant eye level so said at least one person occupant can see externally through said openings at said ends.

6. The swing of claim 4 wherein a canopy is defined over said seat and wherein said canopy includes longitudinally extending lath members.

7. The swing of claim 6 wherein said structural framework and lath members are formed of wood and said auxiliary lineal support members and said main lineal support members comprise respective metallic chain.

8. The swing of claim 1 wherein said main lineal support members are connected with a main support beam of a support base said main support beam being held substantially horizontal by substantially vertical support beams of said support base; wherein said support base has a floor structure and braces are connected intermediate said floor structure and said substantially vertical members to maintain said vertical members substantially veritcal during swinging of said swing.

9. The swing and support base of claim 8 wherein said brace members comprise flexible lineal members that are connected on both sides of said substantially vertical members.

10. The swing of claim 1 wherein said plurality of said main lineal support members comprise chains and wherein said auxiliary lineal support members are connected with said chains about 60 links above the bottom to form a bifurcation.

* * * * *